US006036005A

United States Patent [19]

Krause et al.

[11] Patent Number: 6,036,005

[45] Date of Patent: Mar. 14, 2000

[54] PACKAGE FOR STORING, MIXING AND DISPENSING MULTI-COMPONENT PRODUCTS

[76] Inventors: Arthur A. Krause, 20539 Archwood St., Winnetka, Calif. 91306; Walter K. Lim, 14720 Horticultural Dr., Hacienda Heights, Calif. 91745

[21] Appl. No.: 09/310,083

[22] Filed: May 11, 1999

[51] Int. Cl.[7] ..... B65D 25/08

[52] U.S. Cl. ..... 206/221; 206/229; 206/568; 215/DIG. 8

[58] Field of Search ..... 206/568, 219, 206/220, 221, 229; 215/DIG. 8; 401/4, 132, 137, 192, 196

[56] References Cited

U.S. PATENT DOCUMENTS

| | | | |
|---|---|---|---|
| 2,371,774 | 3/1945 | Nosik | 206/221 |
| 2,615,448 | 10/1952 | Fields . | |
| 2,781,141 | 2/1957 | Lucien . | |
| 3,221,917 | 12/1965 | Santo et al. . | |
| 3,239,429 | 3/1966 | Menolasino et al. | 206/221 |
| 3,255,926 | 6/1966 | Modderno | 206/221 |
| 3,458,076 | 7/1969 | Babcock . | |
| 3,584,211 | 6/1971 | Rauhut . | |
| 3,696,919 | 10/1972 | Miles . | |
| 3,718,235 | 2/1973 | Cronan . | |
| 3,741,383 | 6/1973 | Wittwer . | |
| 3,856,138 | 12/1974 | Maekawa et al. . | |
| 4,093,067 | 6/1978 | Hollander, Jr. | 206/219 |
| 4,433,779 | 2/1984 | Schmid, Jr. et al. . | |
| 4,537,308 | 8/1985 | Hollander, Jr. | 206/221 |
| 4,556,325 | 12/1985 | Katzin . | |
| 4,927,012 | 5/1990 | Rowe | 206/219 |
| 5,277,303 | 1/1994 | Goye et al. . | |
| 5,346,061 | 9/1994 | Newman et al. . | |
| 5,458,244 | 10/1995 | Emori | 206/221 |

*Primary Examiner*—Paul T. Sewell
*Assistant Examiner*—Luan K. Bui
*Attorney, Agent, or Firm*—Dennis H. Lambert

[57] ABSTRACT

A package for storing, mixing and dispensing multi-component products in which the components must be maintained separate from one another until just prior to use, and then mixed together for use. The package includes an outer container for holding a first material, and an inner container within the first container for holding a second material. The inner and outer containers, and particularly the inner container, are flexible tubes with a flattened and sealed end. The other end of the inner tube is closed by a displaceable plug which may be displaced therefrom upon exertion of a predetermined compressive force caused, for example, by simultaneously squeezing the outer and inner containers. Displacement of the closure plug from the inner container enables the first and second materials to be mixed together. A valved closure is on the other end of the outer container to maintain it closed until it is desired to mix and dispense the material therein, and an applicator is carried by a resilient applicator adaptor releasably attached to the closure, for applying the material to a surface.

21 Claims, 5 Drawing Sheets

PACKAGE FOR STORING, MIXING AND DISPENSING MULTI-COMPONENT PRODUCTS

BACKGROUND OF THE INVENTION

1. Field of the Invention

This invention relates generally to packages for storing and dispensing product. More particularly, the invention relates to a package for storing, mixing and dispensing multi-component products that must be maintained separate from one another until ready for use, and then mixed together just prior to use.

2. Prior Art

Many products require the admixture of separate components to produce a material ready for use, but once mixed together the material must be used quickly or it will become unsuitable for use. Examples of such products are two component epoxy and urethane paints, epoxy adhesives, and the like, which comprise a base material to which an accelerator or catalyst is added just prior to use.

Some touch-up paints for military and industrial use, for example, require the admixture of multiple components just prior to use. These paints may comprise an epoxy or urethane base to which an accelerator or hardener is added in a predetermined proportion just prior to use of the paint, which is then applied to a surface to be coated, such as the exposed heads of rivets, scratches, or the like.

A two-component paint and applicator device currently on the market is made by Courtaulds Aerospace, Inc. of Indianapolis, Ind., and marketed as Desoto Series 420 High Solids Gloss Polyurethane Coating, Sempen™ Applicator. This device comprises a syringe-like container with a brush applicator on one end and means for storing the base material and activator separately until ready for use, at which time the activator can be mixed with the base and the admixed material dispensed through the brush for application to a surface. More specifically, this device includes an elongate cylindrical housing whose interior is divided into two compartments by a transverse disk extending across the interior of the housing and frictionally held in place to maintain the two components of the polyurethane coating separate from one another until ready for use. When it is desired to use the paint, the housing is squeezed to dislodge the disk, enabling the two components to be mixed together. The mixed paint is then dispensed through the applicator brush.

A variety of other containers for holding multiple components separate from one another in a single package and then enabling them to be admixed are exemplified in U.S. Pat. Nos. 2,615,448, 2,781,141, 3,221,917, 3,458,076, 3,584,211, 3,696,919, 3,718,235, 3,741,383, 3,856,138, 4,433,779, 4,556,325, 5,277,303 and 5,346,061.

U.S. Pat. No. 2,615,448 provides a multiple chamber package having an inner tubular member 12 with an open end removably secured to a flexible cover member or plug on an outer container. The cover may be manually depressed to dislodge the inner tubular member, whereby the material in the inner member can be mixed with the material in the outer container.

U.S. Pat. No. 2,781,141 discloses an arrangement similar to that in U.S. Pat. No. 2,615,448, except that the flexible closure member on the outer container is pulled outwardly to release the inner container.

U.S. Pat. No. 3,221,917 describes a device in which an expandable container is held within an outer shell, and upon removal of the outer shell, the expandable container may be expanded to remove a stopper from an inner container to permit mixing of the material in the inner container with the material in the expandable container.

U.S. Pat. No. 3,458,076 describes a mixing container in which an inner compartment is held by a reversible closure member on the outer container, and upon removal and reversal of the closure member, the inner container is released and opened to permit mixing of the materials in the inner and outer containers.

U.S. Pat. No. 3,584,211 describes a device for mixing a material held within an outer tube with a material held within an inner frangible tube. By bending the flexible outer tube, the inner frangible tube is broken to release the material therefrom into the material in the outer tube.

U.S. Pat. No. 3,696,919 describes a double container with mixing means in which an inner container is held to and closed by a closure member that also closes an expandable outer container. By partially collapsing the outer container, the inner container may be grasped and pulled away from the closure to permit mixing of the materials in the inner and outer containers.

U.S. Pat. No. 3,718,235 describes a mixing device in which an inner container is disposed within an outer container, and has a closure plug that is displaced by a spring held compressed by a member that is dislodged upon shaking or agitation of the container.

U.S. Pat. No. 3,741,383 describes a mixing container in which an inner compartment has an end wall that it pierced by a tool inserted through an opening in the outer container, to enable admixing of the materials in the inner compartment and the outer container.

U.S. Pat. No. 3,856,138 describes a compartmentalized container in which the inner compartment and outer container are both secured to a common closure cap, and the inner container has an open bottom telescopically received over a closure plug on the outer container. When the threaded closure cap is disengaged from the outer container, it pulls the inner container from this closure plug, to enable admixture of the materials held within the inner compartment and outer container.

U.S. Pat. No. 4,433,779 describes a device for storing and mixing amalgam components, in which a first material is held within an inner compartment and a second material is held within an outer compartment. The inner compartment is opened to release material into the outer compartment by vibrating or shaking the outer compartment.

U.S. Pat. No. 4,556,325 describes a compartmentalized mixing apparatus in which a barrier member is positioned across the interior of the container, dividing it into two compartments for holding separate materials. A tool can be engaged with the barrier member to disengage it and establish communication between the two compartments, whereafter the barrier member can be utilized as an agitating device.

U.S. Pat. No. 5,277,303 describes a package in which two separate containers are engaged with one another in stacked relationship. When a user wishes to use the packaging to mix the components in the two containers, one container is removed from an intermediate component joining the two containers together, and cap 25 is unscrewed. Neck 24 is then inserted into duct 9 and axially pushed while being turned until lugs 28 come into contact with the base of helical ramps 29. Rotational movement between bottle 2 and component 8 causes upward movement such that the neck 24 eliminates plug 10, thus opening the first container or bottle 1, establishing communication between the two bottles, which may then be shaken to mix together the materials contained therein.

U.S. Pat. No. 5,346,061 describes a treatment delivery system in which a flexible outer package has a frangible inner package contained therewithin. The inner container or package is burst by applying pressure to the outer container at the location of the inner container, whereby the materials in the inner and outer containers are admixed. This material wets a foam appliance held within the outer container, which then may be removed from the outer container for use.

Another prior art applicator is the "plastique'Amp"™ made by James Alexander Corporation of Blairstown, N.J. This device is a glass-free crushable ampoule molded of plastic for use with a variety of products. Another device made by this company is its "ampoule-in-a-bottle", particularly useful as a package for diagnostic products and other dual component applications which require the separate storage of the components prior to use. This product has a crushable ampoule within a bottle that is squeezed to apply pressure to the ampoule to crush it.

The prior art devices are relatively complex and expensive in construction, and some of them require the use of separate tools in order to bring the two compartments into communication with one another for mixing the products held therein. Other of the prior art devices require manipulation, such as shaking, or movement of closure members, or movement of one compartment relative to the other, to open the inner container. These devices may not be reliable in operation, and/or may be opened accidently during shipping and handling, and in any event require undue manipulation by the user.

Accordingly, there exists a need for a reliable, simple and inexpensive package for holding at least two materials separate from one another until it is desired to admix the materials for use, and for then enabling the materials to be easily mixed together when desired, and which provides for easy application of the material directly from the package to a surface.

SUMMARY OF THE INVENTION

The present invention provides a simple and economical package which reliably holds plural materials separate from one another until it is desired to admix the materials to produce a product ready for use, and then enables the plural materials to be easily and reliably mixed together, without requiring the use of separate tools or undue manipulation of the package or its components, after which an applicator on the package can be used to apply the product to a surface.

The invention also provides a package for storing and dispensing fluent material in which a valved closure cap is on the open end of a flexible container having a closed end and an open end, to maintain the container closed when the closure cap is in a closed position, and having a valve-controlled outlet opening to enable fluent material to be dispensed therefrom when the closure cap is opened. An applicator adaptor is on the closure cap for supporting an applicator on the container for applying material dispensed therefrom to a surface. The applicator has a first end permeable to the fluent material disposed adjacent the valve-controlled outlet to receive the fluent material dispensed from the container, and a second end permeable to the fluent material and through which the fluent material flows for application to a surface when the fluent material is dispensed from the container.

According to a preferred embodiment, the package of the invention provides for storing, mixing and dispensing multi-component products, and comprises a flexible outer housing or container having an openable closure on one end and holding a first material, and a flexible inner housing or container disposed within the outer container and holding a second material, with a releasable closure plug on the inner container that may be displaced upon squeezing the outer container and exerting pressure on the inner container, to bring the first and second materials into contact with one another and enable them to be admixed. The materials may be thoroughly mixed together by shaking and/or kneading the outer container, with the displaced closure plug from the inner container serving as an agitator. The admixed material may then be dispensed through the openable closure and an applicator tip on the closure. Different applicators may be substituted for specialized application of the material, if desired.

In a first embodiment of the invention, the inner container is loosely received within the outer container, and in a second embodiment the inner container is fixed relative to the outer container.

In a preferred form of the invention, both the inner and outer containers comprise flexible tubes with one end flattened and sealed, and an openable closure member applied to the other end of each. In that embodiment where the inner and outer tubes are secured together, the flattened ends of the inner and outer tubes may be coincident and sealed together.

The openable closure on the outer tube may comprise any suitable structure, including the "Center Dispensing Twist Cap" manufactured by Tubed Products of Oxnard, Calif. This closure member is permanently attached to the end of the tube and includes a center dispensing opening in an end wall thereof, with a valve closure plug movable into and out of the opening upon rotation of the cap through approximately one-quarter of a turn.

The closure for the inner tube comprises a plug frictionally engaged on the open end of the inner tube, whereby pressure applied to the inner tube by squeezing the outer and inner tubes dislodges the plug from the open end thereof, to establish communication between the interiors of the inner and outer tubes and enable admixing of the materials held therein. Upon displacement, from the inner tube, the plug may serve as an agitator to assist in thoroughly admixing the materials from the inner and outer containers. Similarly, in that embodiment where the inner container is loosely received in the outer container, the inner container itself may comprise an agitator. Additionally, a separate agitator ball or other relatively heavy mass may be provided in the outer container and/or the inner container to assist in admixing the product.

The flexible tubes forming the inner and outer containers may be made from any suitable material, although in the preferred embodiment they are made from high-density polyethylene (HDPE). The tubes may be suitably treated, as by fluorination, to seal the surface against permeation by the molecules of products that may be contained in the tubes. A suitable fluorination process is available through Fluoro-Seal, Inc., of Houston, Tex., as "Fluoro-Seal"™. In a specific construction, each tube has a wall thickness of approximately 0.018 to 0.022 inch, with the outer tube having a length of from about seven to about eight inches, and a width or diameter of about two inches. The inner tube, in this example, has a length of from about four inches to about four and one-half inches, and a width or diameter of about one and three-eighths inches. The outer tube may be made in accordance with the techniques employed to manufacture the tube to which the center dispensing closure cap of Tubed Products is applied.

In a specific construction of the preferred form of the invention, the outer tube has a capacity of approximately six to seven ounces, but only approximately one ounce of base material is placed therein. Depending upon the ratio of the two materials to be admixed, for example, 1:1, approximately one ounce of activator or catalyst may be placed in the inner tube, which has a capacity of about two ounces. This insures that there is adequate head space in the outer tube to prevent pressure build-up that might inadvertently displace the plug from the inner tube during storage and handling, and to provide adequate space for mixing the two materials, but at the same time enable squeezing of the inner tube, through the outer tube, to displace the closure therefrom.

To achieve different ratios of materials in the inner and outer tubes and at the same time insure that the plug will be displaced from the inner container when it is squeezed, but will not open inadvertently due to pressure build up caused by ambient conditions, the inner tube can be provided in different sizes. For instance, if a ratio of 3:1 is desired between the materials in the outer tube and the inner tube, the inner tube can be only one-third as large as that used when a ratio of 1:1 is desired.

Further, the applicator preferably comprises an open cell foam material that is extruded into an elongate tubular shape and then die-cut to desired lengths. The end of the applicator that is to be used for applying the material to a surface may be given a desired shape by die-cutting across the tip of the applicator. Additionally, the extruded foam material has a skin formed on its outer surface which remains in place except at the exposed ends that are die-cut. This skin prevents "donuting" of the coating material around the applicator when the applicator is pressed onto a surface to be coated.

In its broadest aspect, the invention contemplates a package for storing and dispensing fluent material, comprising a flexible container having a closed end and an open end, a valved closure cap on the open end to maintain the container closed when the closure cap is in a closed position, and having a valve-controlled outlet to open the container to enable fluent material to be dispensed therefrom when the closure cap is opened, an applicator adaptor on the closure cap for supporting an applicator on the container for applying material dispensed therefrom to a surface, and an applicator carried by the applicator adaptor, a first end permeable to the fluent material disposed adjacent the valve-controlled outlet to receive the fluent material dispensed from the container, and a second end permeable to the fluent material and through which the fluent material flows for application to a surface when the fluent material is dispensed from the container.

In a more particular aspect, and according to a preferred embodiment, the invention contemplates a package for storing, mixing and dispensing multi-component products, comprising a flexible outer container for holding a first material, a flexible inner container confined within the outer container for holding a second material separate from the first material, said flexible inner and outer containers being deformable upon the exertion of pressure thereon to collapse the inner container and apply pressure to the contents thereof, a displaceable closure plug on said inner container to close said inner container and isolate the second material from the first material during storage and shipment, said closure plug being displaced from the inner container to open the inner container and establish contact between the first and second materials upon the exertion of pressure on the outer and inner containers by a user squeezing the outer and inner containers when it is desired to mix the first and second materials together to form said multi-component product, and an openable closure cap on the outer container to maintain the outer container closed during storage and shipment, but openable to enable dispensing of the multi-component product when desired.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
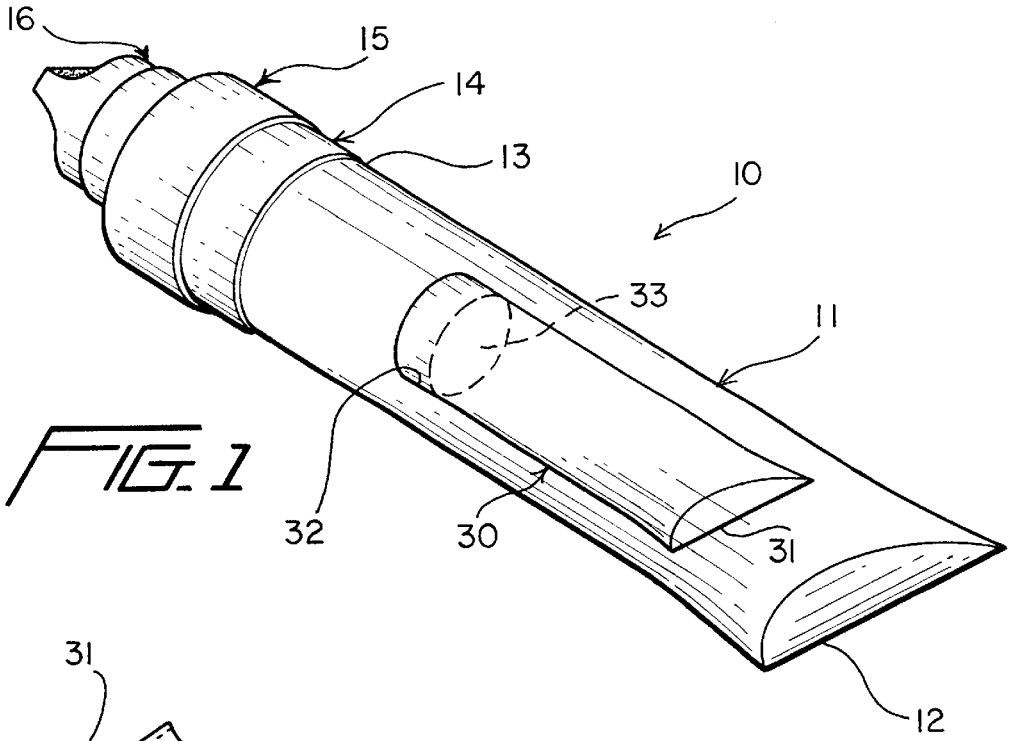
FIG. 1 is a perspective view of a package for storing, mixing and dispensing multi-component products according to the invention.
Figure 7:
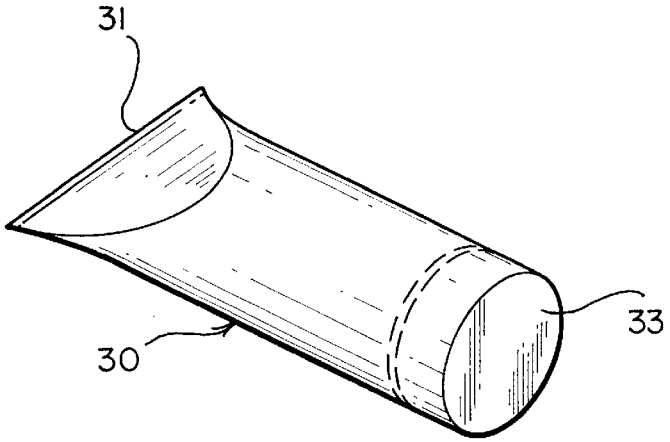
FIG. 7 is a perspective view of the inner tube used in the package of FIG. 1.

A first form of the invention is indicated generally at 10 in FIGS. 1–6, wherein an outer container 11 of tubular construction has a closed end 12 and an open end 13 to which a valved closure cap 14 is permanently attached in a known manner. A suitable commercially available closure is made by Tubed Products of Oxnard, Calif., for example, as a center dispensing twist cap. It should be understood, however, that other types of closures can be used to maintain the container closed until it is desired to use the product. An applicator adaptor 15 is releasably secured on the closure 14, and an applicator tip 16 is secured to the adaptor.

Figure 8:
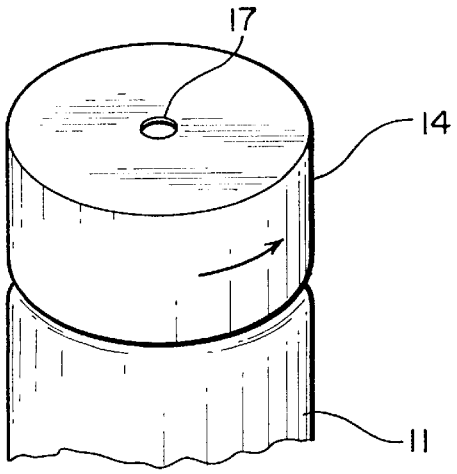
FIG. 8 is a fragmentary perspective view of the openable closure used in the package of FIG. 1, showing the closure moved to an open position.
Figure 9:
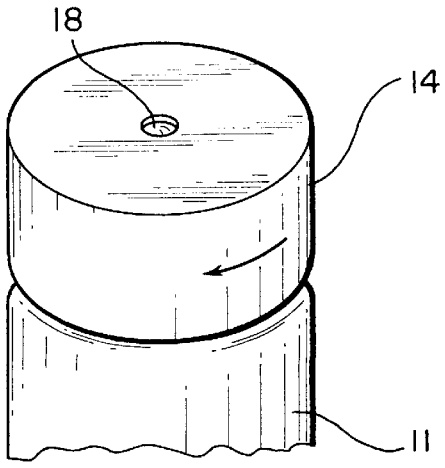
FIG. 9 is a view similar to FIG. 8, showing the closure moved to a closed position.

As seen best in FIGS. 8 and 9, the closure 14 has a central opening 17 in its end wall, and this opening is closed by a valve protrusion 18 on an inner member (not shown). When the closure cap is rotated counterclockwise, the valve protrusion 18 retracts from the opening 17 to permit flow of material from the tubular container through the opening 17. When the closure cap is rotated in a clockwise direction, the valve protrusion 18 extends into the opening 17, blocking the flow of material therethrough. Since this closure cap arrangement is commercially available from Tubed Products, further description is believed unnecessary herein.

Figure 5:
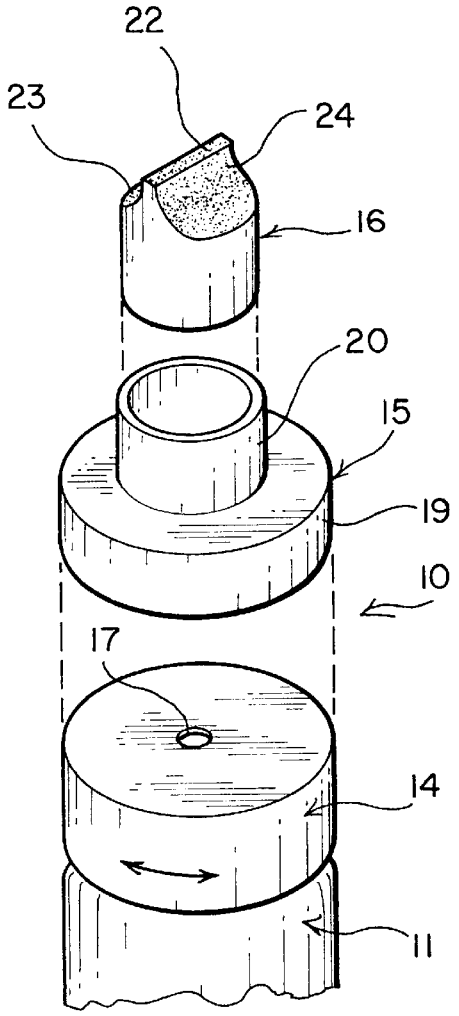
FIG. 5 is a fragmentary, exploded perspective view showing the openable closure, the applicator adaptor, and the applicator as used in the package of FIG. 1.
Figure 6:
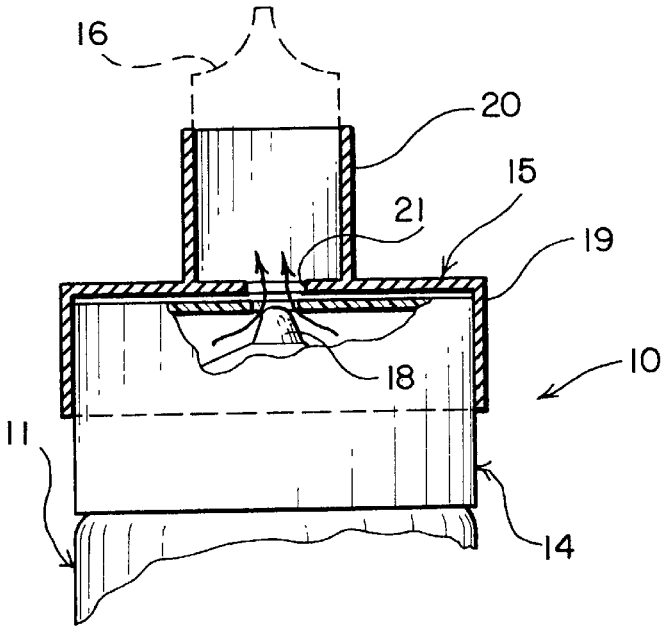
FIG. 6 is an enlarged, fragmentary, longitudinal sectional view of the applicator adapter and closure, with portions of the closure and package broken away for purpose of clarity.

As seen best in FIGS. 5 and 6, the adaptor 15 has a diametrically enlarged base with a depending cylindrical skirt 19 adapted to be snugly frictionally engaged on the closure cap 14 so that it is held thereon in normal use, but can be removed when desired. A reduced diameter cylindrical sleeve 20 projects upwardly from the center of the base, and an opening 21 extends through the adaptor in communication with the opening 17 in the closure cap when the adaptor is placed thereon, for flow of material from the opening 17 and through the opening 21 into the interior of the sleeve 20. The adaptor is pliant so that the skirt 19 may be stretched over the closure cap 14 to resiliently grip the cap to hold the adaptor in place. In a preferred construction, the adaptor is made of neoprene rubber.

The applicator tip 16 may comprise any suitable material through which the material can flow for application to a surface, and in a preferred embodiment comprises an open cell foam material that is extruded in elongate cylindrical form, and then cut to desired lengths, with a desired tip end configuration provided by die-cutting one end of the cut segments. These applicator segments are then permanently secured in the sleeve 20 by use of an adhesive or the like. It will thus be seen that the open cell foam material of the applicator tip is exposed at its base end, in communication with the opening 21, and is also exposed at its shaped end, but is sealed around its outer surface by the skin formed during the extrusion process.

As shown in the preferred embodiment described herein, the shaped end of the applicator tip has a rectangularly shaped transverse bar 22 at its extreme outer end, with oppositely sloping tapered or curved sides 23 and 24. With this configuration, paint or other material absorbed into the open cell foam material of the applicator tip may be applied by touching the bar 22 to the surface to be treated, or the entire end of the applicator tip may be pressed against the surface to be treated simply by exerting greater pressure of the device against the surface. Thus, this particular form of applicator tip is especially suited for applying paint to a scratch or other elongate blemish, and/or for applying a circular dab of paint to a surface such as an exposed rivet head or the like. It also may be used for applying paint or other material by moving the applicator along the surface in a fore and aft stroking motion.

If the foam applicator tip did not have a skin thereon as described above, a circular bead of material would form around the outer surface of the applicator tip when it is pressed against a surface to be treated, resulting in waste of material and unsightly results. However, the provision of the skin around the applicator tip except at its exposed end surfaces prevents the formation of this bead of material, insuring uniform results.

It will be apparent from the foregoing that the structure thus far described is suitable for applying a material to a surface, and has utility apart from use of the invention for material that requires the admixture of multiple components just prior to use. That is, the invention thus far described could be used for applying paints, adhesives, or other materials that do not require the admixture of multiple components just prior to use.

As embodied herein, however, the invention is especially adapted for use with materials which must be maintained separate from one another until ready for use, and then mixed together. To that end, the invention includes an inner container 30 within the outer container 11, with the outer container holding a first material $M_1$ and the inner container holding a second material $M_2$.

The inner container 30 has a closed end 31 and an open end 32, with a frictionally retained closure plug 33 engaged on the open end. In the particular construction described and illustrated herein, the closure plug is fitted inside the open end 32 of the inner container 30, much like a cork in a bottle, and when pressure is applied to the inner container, by squeezing the outer container as shown schematically in FIG. 3, the closure plug 33 is dislodged from the open end 32, enabling the contents of the inner container to mix with the contents of the outer container. It may be necessary to open the closure cap 14 to permit the escape of air from the outer container and enable the closure plug 33 to be displaced when the outer tube is squeezed to compress the inner tube.

In the preferred embodiment, the inner and outer containers are constructed as tubes made of a flexible material such as high-density polyethylene. It is also preferred that the tubes be treated to seal the inner and outer surfaces against permeation by molecules of the material held therein, as by application of a fluorination process such as that available through Fluoro-Seal, Inc., under the name "Fluoro-Seal"™.

The closed ends 12 and 31 of the respective outer and inner tubes may be closed and sealed by use of a heat seal or other form of energy or by the use of an adhesive or the like, as desired.

If the center dispensing twist cap of Tubed Products is used as the openable closure 14, the closure will likely be made of polypropylene, although other materials could be used. Additionally, the closure will also be treated, as by use of the "Fluoro-Seal"™ process to prevent permeation through it of the material held within the tube 11.

The valve plug 33 may be made of any suitable material, although neoprene is particularly suitable, especially considering the chemical composition of the materials intended to be held within the inner and outer containers in accordance with the invention. This plug is also preferably treated to prevent permeation through it of the material in the inner or outer containers.

Although the package of the invention may be used to store, mix and then apply a large variety of materials, it is especially adapted for use with the coatings manufactured by Deft, Inc. of Irvine, Calif. for military and industrial use. These coatings include primers, sealants and pigmented coatings meeting military specifications. A few examples of these primers and pigmented coatings include Deft's VOC compliant waterborne primers, MIL-P-85582 and MIL-P-53030, and high solids polyurethanes, MIL-C-85285, Types I and II.

Figure 2:
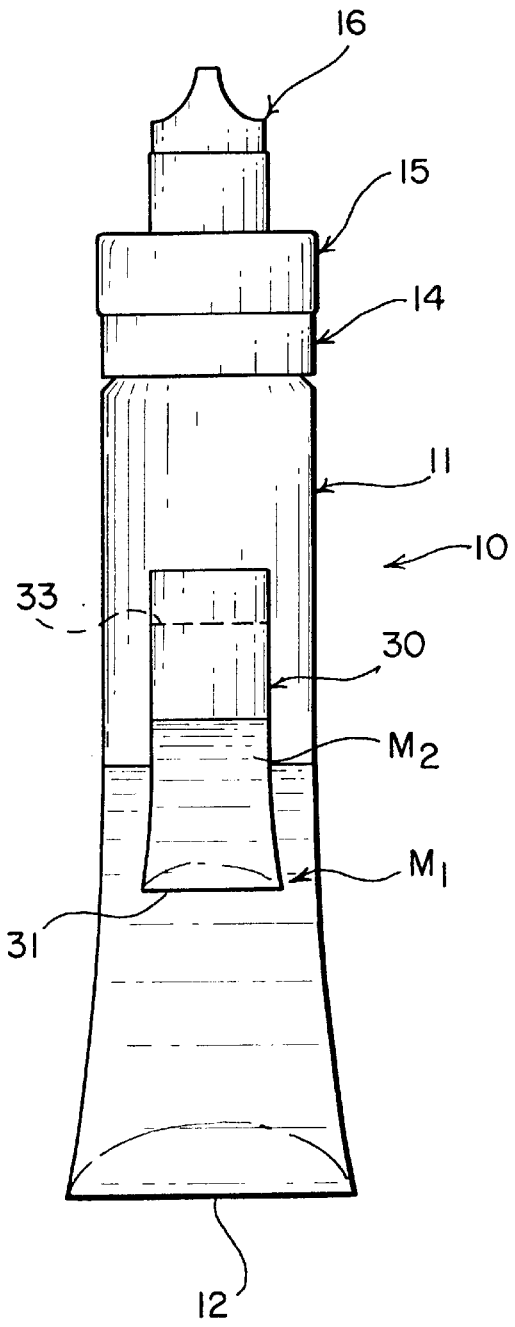
FIG. 2 is a front view in elevation of the package of FIG. 1.
Figure 3:
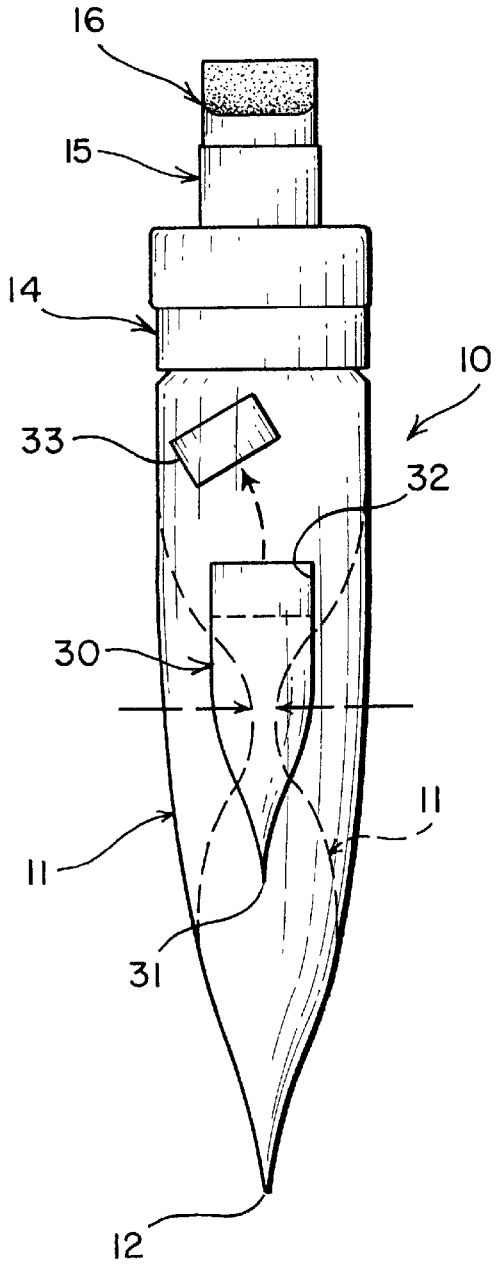
FIG. 3 is a side view in elevation of the package of FIGS. 1 and 2, showing schematically how pressure is applied to the outer tube to squeeze the inner tube and release its closure, whereby the materials in the inner and outer tubes can be admixed.
Figure 4:
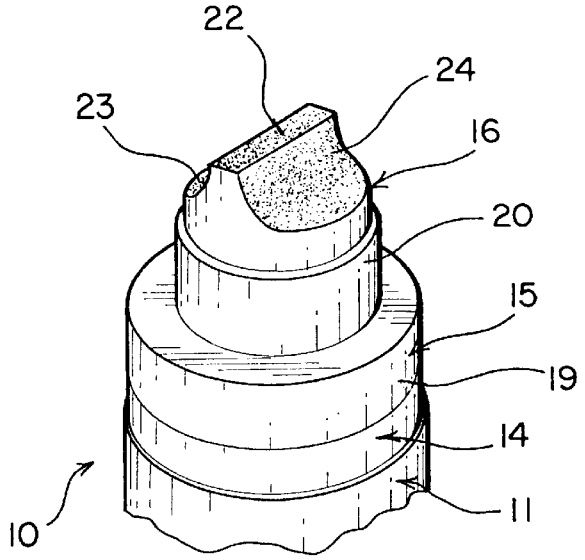
FIG. 4 is a fragmentary, enlarged, top perspective view of the applicator end of the package of FIG. 1.

In the embodiment of the invention shown in FIGS. 1–3, the inner container 30 is not fixed relative to the outer container, but is free to move about therein. In this form, when pressure is applied to dislodge the closure plug 33 to mix the contents of the inner and outer containers, the closure plug 33 as well as the inner container itself become agitators to facilitate mixing of the materials. If desired, a separate agitator ball (not shown) may be provided in the outer container to assist in mixing the materials.

In the embodiment shown in FIGS. 12–15, the package 40 comprises an outer container 11 having a closure cap 14, adaptor 15 and applicator 16 as in the previously described form of the invention. However, the inner container 41 has its closed end 42 placed coincident with the closed end 12' on the outer container 11, and sealed therewith, whereby the closed ends of the inner and outer containers are coincident and sealed together. To facilitate alignment of the ends of the inner and outer containers during manufacture, the closed end of the inner container 41 may have a lip or flange 43 thereon forming a hook to support the inner container on the outer container with their ends in alignment so that they may be sealed together in a single step, to form a sealed end 44 common to both the inner and outer tubes.

The ends of the tubes may be sealed together in any suitable way, as by an ultrasonic weld, a heat seal, adhesive, or other suitable means. Two heat bars 45 are shown schematically in FIG. 14, which may be pressed against the aligned ends of the tubes to close and seal them together.

Figure 10:
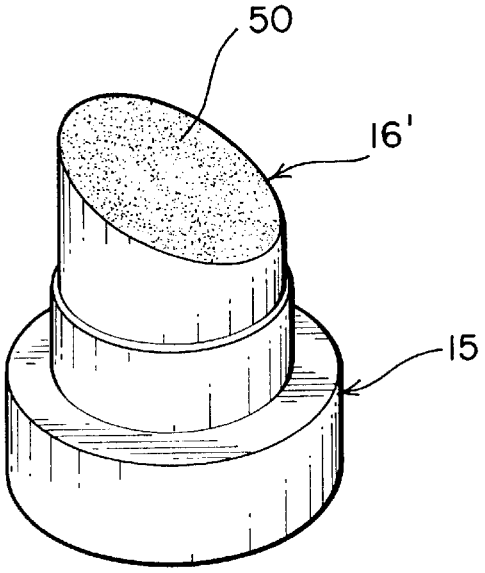
FIG. 10 is a slightly enlarged top perspective view of a modified applicator according to the invention.
Figure 11:
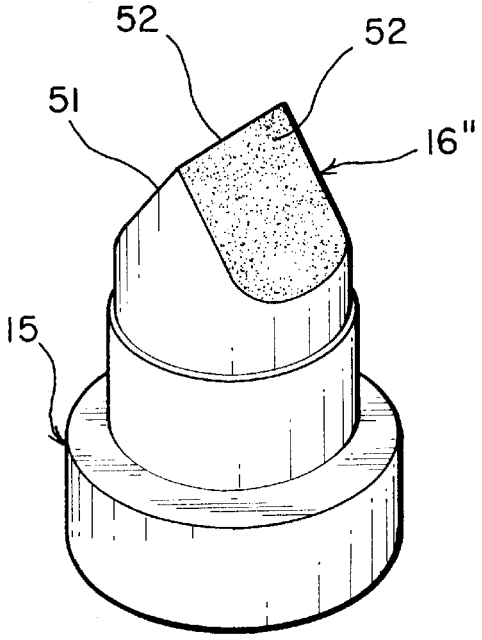
FIG. 11 is a view similar to FIG. 10 of a further modified applicator according to the invention.
Figure 12:
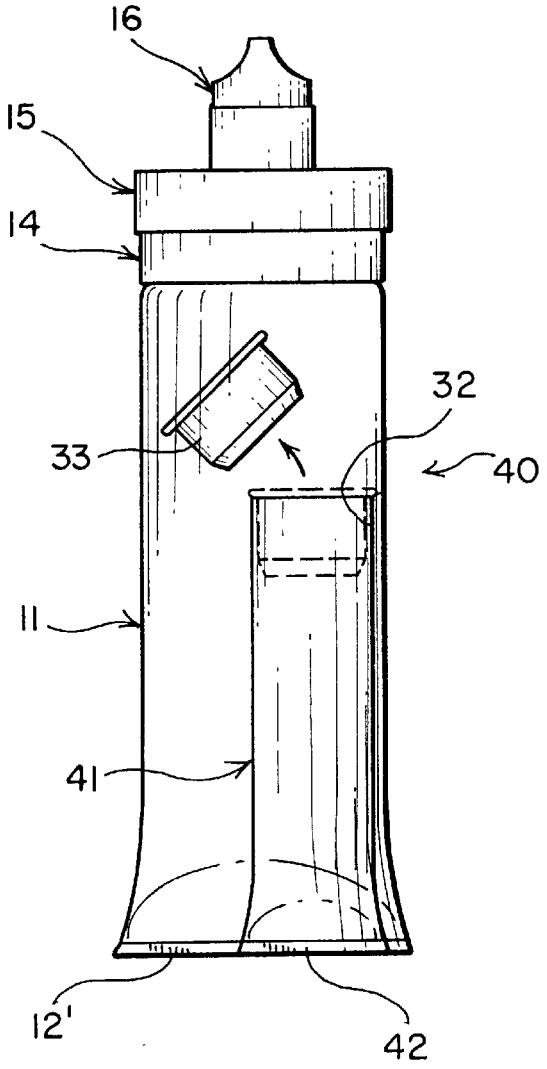
FIG. 12 is a front view in elevation showing a modified package, wherein the inner tube is secured in position relative to the outer tube so that the ends of the inner and outer tubes are coincident and sealed together.
Figure 13:
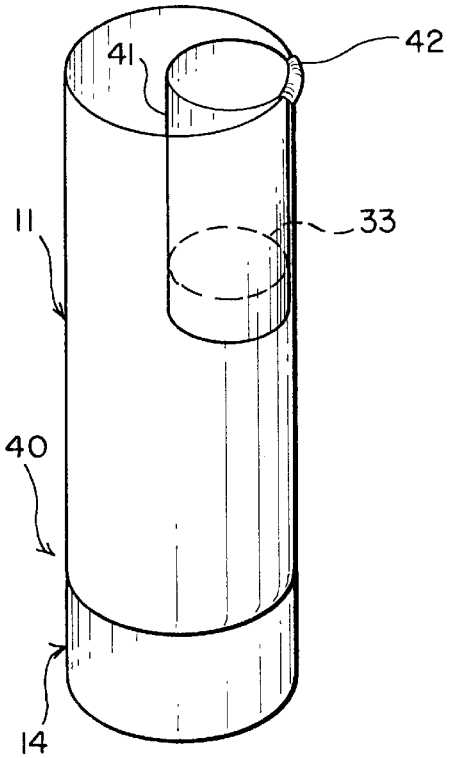
FIG. 13 is a bottom perspective view showing how the inner tube may be positioned relative to the outer tube before the ends thereof are closed and sealed together to form that embodiment of the invention shown in FIG. 12.
Figure 14:
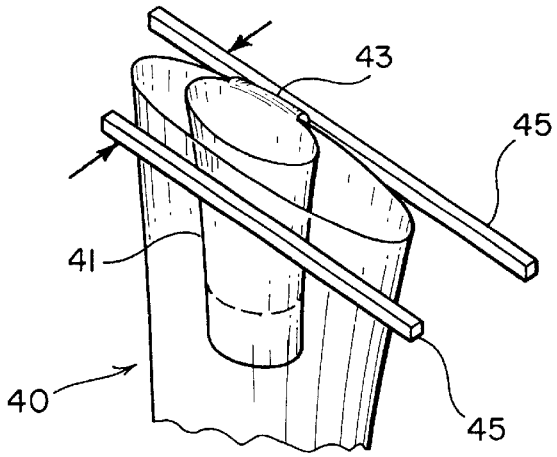
FIG. 14 is a fragmentary bottom perspective view of the embodiment of FIG. 13, showing the tubes in a partially flattened condition to seal them together.
Figure 15:
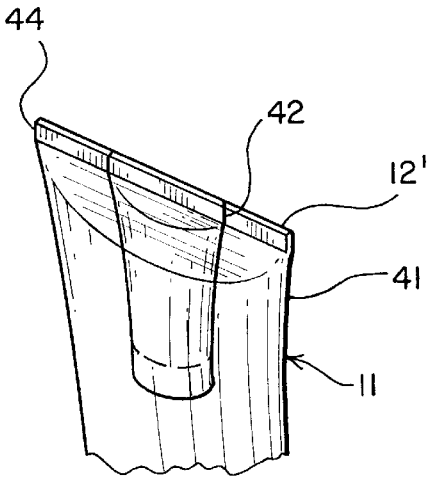
FIG. 15 is a bottom perspective view of the embodiment of FIG. 12, showing the single closure seal across the bottom ends of the inner and outer tubes.

Alternate applicator tip shapes are shown in FIGS. 10 and 11. In FIG. 10, the applicator 16' is die-cut diagonally across its width to form an angled, planar end surface 50. In FIG. 11, the applicator 16" is die-cut to provide two oppositely sloping planar surfaces 51 and 52 terminating in a relatively sharp edge 53 at the free end of the applicator. Other shapes may be given to the applicator tip, as desired, and the shapes illustrated herein are exemplary only, and are particularly suited for the intended purpose of the invention.

Additionally, although the inner and outer containers have been illustrated and described herein as flexible tubes, they could also be in the form of bottles or other types of containers, so long as the outer container may be squeezed or compressed to apply pressure to the inner container to dislodge the closure plug and enable mixing of the materials in the inner and outer containers. Further, one of the containers can be a tube and the other a bottle, if desired.

Figure 16:
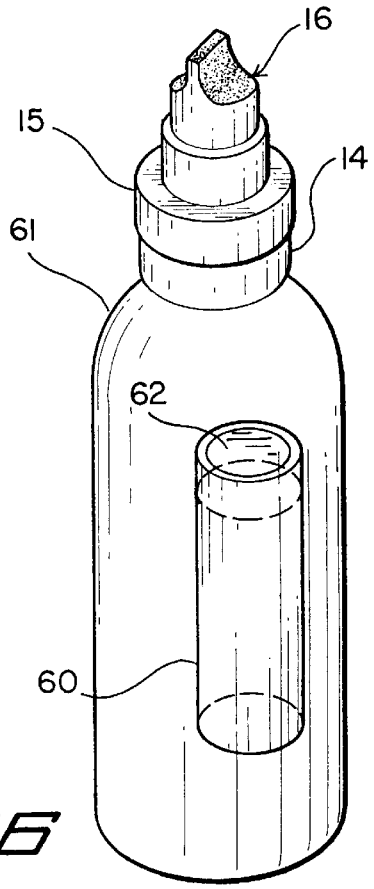
FIG. 16 is a top perspective view of a further embodiment wherein the inner and outer containers comprise bottles.

FIG. 16 shows an inner vial or bottle 60 within an outer bottle 61. A displaceable closure plug 62 is frictionally engaged in the open end of the inner bottle, and a closure cap 63 is engaged on the outer bottle, with an applicator 16 as previously described. The bottles 60 and 61 are somewhat flexible so that they may be squeezed to apply pressure to the inner bottle to dislodge the closure plug 62 and permit mixing of the materials in the inner and outer bottles, just as previously described in connection with the tubes 11 and 30, for example. This form of the invention may be preferred, for example, for hair colorings and similar consumer products.

Further, although particular materials and dimensions have been described herein, it should be understood that other materials and dimensions could be used for different applications of the invention, and it is not intended to limit the invention to the particular materials and dimensions described.

While particular embodiments of the invention have been illustrated and described in detail herein, it should be understood that various changes and modifications may be made to the invention without departing from the spirit and intent of the invention as defined by the scope of the appended claims.

What is claimed is:

1. A package for storing, mixing and dispensing multi-component products, comprising:

a flexible outer container for holding a first material;

a flexible inner container confined within the outer container for holding a second material separate from the first material;

said flexible inner and outer containers being deformable upon the exertion of pressure thereon to collapse the inner container and apply pressure to the contents thereof;

a displaceable closure plug on said inner container to close said inner container and isolate the second material from the first material during storage and shipment, said closure plug being displaced from the inner container to open the inner container and establish contact between the first and second materials upon the exertion of pressure on the outer and inner containers by a user squeezing the outer and inner containers when it is desired to mix the first and second materials together to form said multi-component product; and an openable closure cap on the outer container to maintain the outer container closed during storage and shipment, but openable to enable dispensing of the multi-component product when desired.

2. A package as claimed in claim 1, wherein:

the inner container is configured so that pressure therein is toward the end with the closure plug when an external compressing force is applied to the inner container.

3. A package as claimed in claim 2, wherein:

the inner container is a tube with a flattened and sealed closed end, and an open end in which the closure plug is frictionally received.

4. A package as claimed in claim 3, wherein:

the outer container is a tube with a flattened and sealed closed end; and the openable closure cap is on the other end.

5. A package as claimed in claim 4, wherein:

the openable closure cap is permanently attached to said other end of the outer tube, and comprises a twist cap with a valved closure movable between open and closed positions upon opposite rotational movement of the cap.

6. A package as claimed in claim 1, wherein:

an applicator is on said closure cap for applying the product from the package to a surface.

7. A package as claimed in claim 6, wherein:

said applicator is replaceable to enable applicators to be substituted when desired.

8. A package as claimed in claim 7, wherein:

the applicator is carried by an applicator adaptor removably received on the closure cap.

9. A package as claimed in claim 8, wherein:

the applicator adaptor comprises a flexible member having a base with a depending cylindrical skirt that is resiliently engaged on the closure cap, and a cylindrical projection extending axially away from the base; and said applicator is carried by said cylindrical projection.

10. A package as claimed in claim 9, wherein:

the applicator comprises an open cell foam material through which the product passes when dispensed from the package.

11. A package as claimed in claim 10, wherein:

the applicator has inlet and outlet ends at which the foam material is exposed, and a skin is on the sides of the applicator to constrain flow of product from the inlet end to the outlet end.

12. A package as claimed in claim 11, wherein:

the inner container is configured so that pressure therein is toward the end with the closure plug when an external compressing force is applied to the inner container.

13. A package as claimed in claim 12, wherein:

the inner container is a tube with a flattened and sealed closed end, and an open end in which the closure plug is frictionally received.

14. A package as claimed in claim 13, wherein:

the outer container is a tube with a flattened and sealed closed end; and the openable closure cap is on the other end.

15. A package as claimed in claim 14, wherein:

the openable closure cap is permanently attached to said other end of the outer tube, and comprises a twist cap with a valved closure movable between open and closed positions upon opposite rotational movement of the cap.

16. A package as claimed in claim 4, wherein:

the closed end of the inner tube is coincident with the closed end of the outer tube, and the closed ends of the inner and outer tubes are flattened and sealed together in a common closure seam.

17. A package as claimed in claim 16, wherein:

the closed end of the inner tube has a hook-shaped projection thereon which is engaged over the closed end of the outer tube to support the inner tube on the outer tube with their closed ends coincident with one another prior to sealing the closed ends together.

18. A package as claimed in claim 1, wherein:

the inner and outer containers both comprise bottles, each having a closed end and an open end.

19. A package as claimed in claim 18, wherein:

the openable closure cap is permanently attached to the open end of the outer bottle, and comprises a twist cap with a valved closure movable between open and closed positions upon opposite rotational movement of the cap.

20. A package as claimed in claim 19, wherein:

an applicator is on said closure cap for applying the product from the package to a surface.

21. A package as claimed in claim 20, wherein:

said applicator is replaceable to enable applicators to be substituted when desired.

* * * * *